US005571003A

United States Patent [19]

Tuckey

[11] Patent Number: 5,571,003

[45] Date of Patent: Nov. 5, 1996

[54] FUEL PUMP WITH AND METHOD TO MODULATE VAPOR PURGE PORT PRESSURE PULSES

[75] Inventor: Charles H. Tuckey, Cass City, Mich.

[73] Assignee: Walbro Corporation, Cass City, Mich.

[21] Appl. No.: 490,070

[22] Filed: Jun. 13, 1995

[51] Int. Cl.[6] ..... F04C 2/08

[52] U.S. Cl. ..... 418/1; 418/15; 418/171; 418/180

[58] Field of Search ..... 418/1, 15, 46, 418/171, 180; 417/543

[56] References Cited

U.S. PATENT DOCUMENTS 4,697,995 10/1987 Tuckey ..... 418/15

5,263,818 11/1993 Ito et al. ..... 418/15

5,364,246 11/1994 Frank et al. ..... 418/15

*Primary Examiner*—John J. Vrablik

*Attorney, Agent, or Firm*—Barnes, Kisselle, Raisch, Choate, Whittemore & Hulbert

[57] ABSTRACT

A rotary pump for volatile hydrocarbon fuels for use in a fuel system of an internal combustion engine of an automotive vehicle. A pulsation chamber allows purging of fuel vapor from the pump and dampens expansion and contraction of the fuel and vapor due to pressure pulses created during the pumping cycle thereby greatly reducing audible noise of the operating pump. The pulsation chamber has an axial passage with an outlet for returning fuel and vapor from the pulsation chamber to the fuel supply.

5 Claims, 1 Drawing Sheet

FUEL PUMP WITH AND METHOD TO MODULATE VAPOR PURGE PORT PRESSURE PULSES

FIELD OF INVENTION

This invention relates to a fuel pump and more particularly to a fuel pump which modulates pressure pulses.

BACKGROUND OF THE INVENTION

Fuel pumps utilized for providing hydrocarbon fuels in liquid form to the fuel injectors of an internal combustion engine in an automobile or truck are usually powered by an electric motor in which the armature is mounted in the fuel pump body. These pumps must be capable of operating in a wide range of ambient temperatures.

Hydrocarbon fuels have a relatively low boiling point. In certain geographical areas, the ambient temperatures may reach 110° to 120° F. The temperature in the fuel tank below the automotive vehicle may be even higher than this. Since these pumps are frequently mounted in the fuel tanks, there is a great likelihood that the fuel in the pump may vaporize. The pumps are usually positive displacement pumps and it is necessary that the entry to the pump chambers create a low pressure to draw fuel into the pumping chambers.

This reduced pressure alone may cause a change in state of the fuel from liquid to vapor at elevated temperatures and significantly reduce the efficiency of the pump. In another condition, for example, when a vehicle has been operating and then the engine is shut off for a period, the fuel line between the pump and the fuel rail or fuel injectors is full of liquid fuel under pressure whereas the fuel in the pump can be completely vaporized due to the elevated temperature in the fuel tank and pump itself. Thus, when the engine is restarted, the pump is full of vapor and even the fuel in the pump intake filter may be vaporized. The pump cannot, under these conditions, generate enough pressure to move the fuel in the pressurized fuel supply line.

It has been previously known to provide a vapor port in a pump to bleed vapor from the high pressure area of the pump. These devices have been successful in expelling vapor from the pump. For example, U.S. Pat. No. 4,697,995 discloses such a purge port.

However, a noise problem still exists which has not been overcome. It is an inherent characteristic of a positive displacement pump to produce slight pressure pulses during its pumping cycle. Each pressure pulse causes expansion and contraction of the vapor within the purge port which causes an audible noise.

SUMMARY OF THE INVENTION

A positive displacement fuel pump is provided with a vapor purging system that will enable the pump to operate under conditions above described without an interruption of the fuel supply and with greatly reduced audible noise. Generally, the fuel pump has a housing with an electric motor driving a pump rotor such as inner and outer gears creating ensmalling and expanding chambers to pump fuel under pressure to an outlet. A vapor purge port is provided in the housing and opens into a vapor chamber to allow the vapor to expand and contract within the chamber. The vapor chamber has an outlet passage leading back to the fuel tank or supply so that liquid fuel and vapor collected within the chamber can be discharged from the chamber to the fuel tank or supply.

Objects, features and advantages of this invention include providing a fuel pump with a pulse modulating chamber which permits fuel vapor to expand and contract due to pressure pulses produced by the pump, separates liquid fuel from the vapor, discharges the fuel and vapor, reduces noise to provide a quiet operation, and is simple, stable, rugged, durable, reliable, and of relatively simple design and economical manufacture.

BRIEF DESCRIPTION OF THE DRAWINGS

These and other objects, features and advantages of this invention will be apparent from the following detailed description of the preferred embodiment and best mode, appended claims, and accompanying drawings in which:

DETAILED DESCRIPTION

Figure 1:
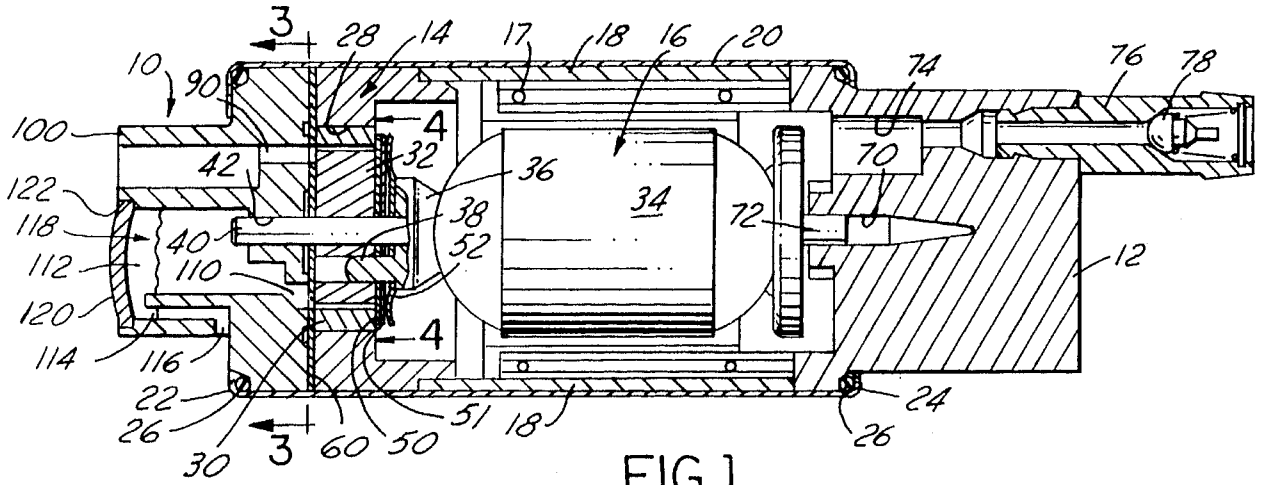
FIG. 1 is a longitudinal section of a positive displacement fuel pump embodying the invention.

With reference to the drawings, the longitudinal section of FIG. 1 shows the components of a positive displacement fuel pump 8 for an engine of an automobile. The pump has an inlet housing 10, an outlet housing 12, a pump housing 14, and an electric motor 16 interposed between the housings 12 and 14. In use, the attitude of the pump immersed in fuel in a fuel tank would be essentially vertical with the inlet housing 14, that is, the left-hand end as viewed in FIG. 1, at the bottom of the tank and connected to a fuel filter.

The stator of the motor has permanent magnets 17 and arcuate flux elements 18 in end-to-end contact with housings 12 and 14. The entire assembly is contained by a cylindrical sheet metal housing 20 with ends 22 and 24 spun or rolled over compressed sealing rings 26. Pump housing 14 has an eccentric recess 28 which houses for rotation an outer gear rotor element 30 and an inner gear rotor element 32. The inner gear rotor element 32 is directly driven by a rotating motor armature 34 which has a drive extension 36 with circumferentially spaced fingers 38 registering with and received in holes 39 in the inner rotor element 32.

A stub shaft 40 in a bore 42 rotatably mounts the inner gear rotor 32 and provides a journal for the armature extension 36. The pump outlet housing 12 provides a bearing recess 70 for a stub shaft 72 at the other end of the armature 34. An outlet passage 74 leads to a fuel line connector 76 containing an outlet check valve 78.

Fuel outlet valves are provided by flexible sheets 50 and 60. Flexible sheet 50 is backed by a second sheet 51 and a spider spring element 52 which bears against the rotor elements 30,32 and rotates with them. Flexible sheet 60 is interposed between housing 10 and housing 14 and overlies the inner face of inlet housing 10 on one side and the gear rotor elements 30, 32 on the other side.

An arcuate fuel inlet port 90 overlies the portion of the gear rotor elements where the pump recesses are expanding. Fuel under pressure in the portion of the gear rotor elements where the pump recesses are ensmalling will escape past the flexible sheets 50 and 60. The fuel under pressure which flexes or bulges the sheet 50 flows directly into the armature chamber and toward the pump outlet 74. The portion of the fuel under pressure which flexes the sheet 60 into a clearance pocket 92 flows through the pocket, axially extending passage 96 and thence to the armature chamber and outlet 74.

As viewed in FIG. 1, the inlet housing 10 has a circular wall 100 which will mount a suitable filter (not shown) in the fuel tank. An inward bulge 102 in the wall has a bore 104 in which a relief valve 106 is received which will relieve excess fuel pressure by by-passing fuel to the tank.

In accordance with the present invention, the vapor purge is accomplished by providing a passage 110 opening to the inner face of the inlet housing 10 and into a pulsation chamber 112 in the housing 10. A small hole is punched in the flexible plate 60 to register with the passage 110. Vapor and liquid fuel are expelled from the chamber 112 and back into the fuel tank through an axial passage 114 having an outlet 116.

The pulsation chamber 112 is a closed chamber defined in part by a blind recess or cavity 118 in the housing 10 with an open bottom closed by a disk 120 received in a recess 122. Preferably, to retain some liquid fuel in the chamber 112, the passage 114 communicates with the chamber immediately adjacent the bottom of the chamber, extends generally axially or vertically upward and opens to the exterior of the housing at a location spaced from and preferably distal from the bottom of the chamber. In operation, this provides in the chamber both a pool of liquid fuel through which the vapor passes and a vapor dome above the liquid fuel into which vapor and liquid fuel is discharged from the port 110.

Figure 4:
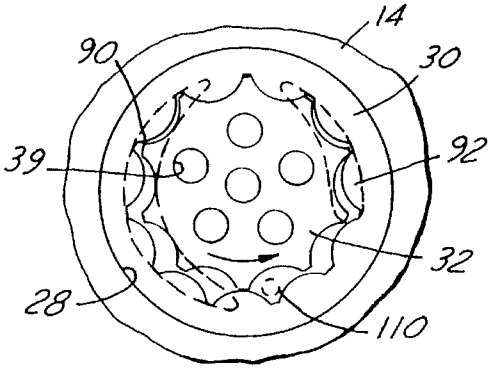
FIG. 4 is a view illustrating the inner and outer rotors of a gear rotor pump taken generally on line 4—4 of FIG. 1.
Figure 3:
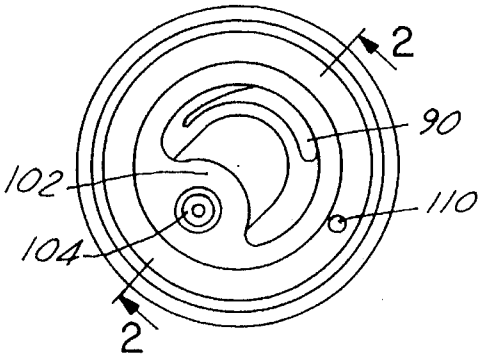
FIG. 3 is a sectional view taken generally on line 3—3 of FIG. 1.
Figure 2:
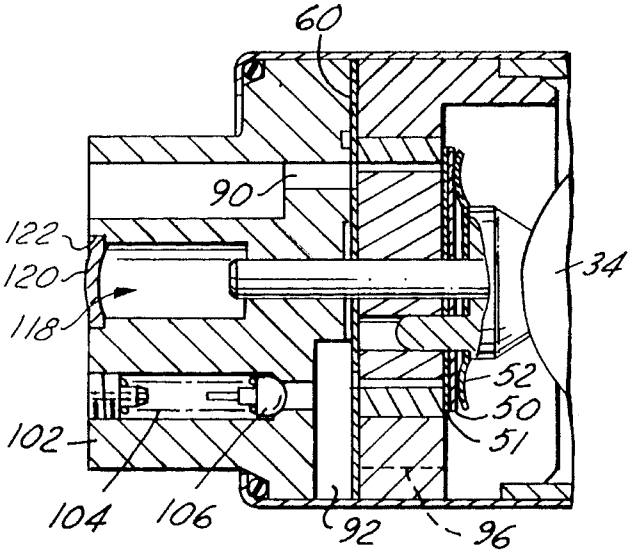
FIG. 2 is an enlarged and fragmentary longitudinal section of the pump taken on line 2—2 of FIG. 3 and at a right angle to the section of FIG. 1.

The port 110 is circumferentially located in the neutral zone of the gear rotors which is generally defined as an area centrally located between the end of the inlet port and the beginning of the outlet port (FIG. 4). Thus, the port 110 is located just past the fuel inlet 90 and generally circumferentially equidistant between the end of the fuel inlet 90 and the beginning of the liquid pocket 92.

In operation of the pump, liquid fuel and fuel vapor flow through the port 110 into the chamber where the fuel and vapor can separate such that the liquid fuel collects in the bottom of the chamber. This provides a vapor zone above the liquid fuel where expansion and contraction of the vapor can occur during the pressure pulses created by the pump during its pumping cycle. Since the fuel vapor expansion and contraction occurs in the chamber 112, the noise created by pressure pulses caused by vapor expansion and contraction in the rotors is eliminated resulting in a quiet fuel discharge with greatly reduced pressure pulsations or fluctuations. The liquid fuel is discharged from the chamber 112 along with the vapor through the passage 114 and outlet 116 which acts as a stand pipe to retain some liquid fuel in the chamber. It is believed the pressure pulses displace or agitate the liquid fuel in the chamber which absorbs and dissipates energy, thereby greatly reducing the audible noise. In any event, regardless of any theoretical explanation, this chamber 112 and outlet passage 114 do provide a quiet discharge of liquid fuel and vapor purged from the pump.

I claim:

1. A rotary pump for pumping a volatile liquid fuel, from a fuel source comprising:

a rotor combination utilizing circumferentially disposed expanding and ensmalling positive-displacement pumping chambers, a first circumferential fuel inlet area on said rotor combination in communication with a fuel source, a second circumferential fuel outlet area on said rotor combination spaced circumferentially from said first area, a stationary outlet housing forming an outlet chamber on one side of said rotor combination and communicating with said outlet area of said rotor combination, a stationary inlet housing having an inlet opening communicating with said first circumferential fuel inlet area of said rotor combination, a purge port in said stationary inlet housing communicating with said pumping chambers downstream of said inlet opening and between said inlet opening and said outlet area to allow vapor in said pumping chambers of said rotor combination to be expelled through said port, and a vapor chamber formed in said inlet housing in communication with said purge port, said vapor chamber having an end spaced from said purge port and a volume sufficient to absorb pressure pulsations, and an outlet passage formed in said inlet housing and extending from said vapor chamber to the exterior of said housing so that vapor and liquid fuel in said vapor chamber can be discharged therefrom through said outlet passage and said vapor chamber being closed except for communication with said purge port and outlet passage.

2. The rotary pump of claim 1 wherein said vapor chamber comprises a recess in said inlet housing and a cover adjacent an end of said inlet housing and underlying at least a portion of said recess, said outlet passage communicates with said recess adjacent said cover and with the exterior of said housing at a location spaced from said cover, and said purge port communicates with said recess at a location distal from said cover and adjacent the rotor combination.

3. The rotary pump of claim 1 wherein said vapor chamber has generally opposed ends with one end adjacent the rotor combination and the other end remote from the rotor combination the one end, said outlet passage communicates with said vapor chamber adjacent the other end of said vapor chamber and communicates with the exterior of said housing at a location spaced from the other end of said vapor chamber and between the other end and the rotor combination.

4. The rotary pump of claim 2 wherein said outlet passage opens to the exterior of said housing at a location remote from the other end of said vapor chamber.

5. A method of reducing noise in a rotary fuel pump for volatile fuel comprising:

providing a gear rotor combination utilizing circumferentially disposed expanding and ensmalling positive displacement pumping chambers, providing a first circumferential fuel inlet area on said rotor combination in communication with a source of volatile fuel, providing a second circumferential fuel outlet area on said rotor combination spaced circumferentially from said first area, providing a stationary outlet housing forming an outlet chamber on one side of said rotor combination and communicating with said outlet area of said rotor combination, providing a stationary inlet housing having an inlet opening communicating with said first circumferential fuel inlet area of said rotor combination, providing a purge port in said stationary inlet housing communicating with said pumping chamber downstream of said inlet opening and between said inlet opening and outlet area to allow fuel vapor in said pump chambers of said rotor combination to be expelled through said port, and providing a vapor chamber in said stationary inlet housing communicating with said purge port, said vapor chamber having an end spaced from said purge port and a volume sufficient to absorb pressure pulsations, and an outlet passage extending from said vapor chamber to the exterior of said fuel pump so that fuel vapor and liquid fuel in said vapor chamber can be discharged therefrom through said outlet passage and said vapor chamber being closed except for communication with said purge port and outlet passage.

* * * * *

UNITED STATES PATENT AND TRADEMARK OFFICE

CERTIFICATE OF CORRECTION

PATENT NO. : 5,571,003

DATED : November 5, 1996

INVENTOR(S) : Charles H. Tuckey

It is certified that error appears in the above-indentified patent and that said Letters Patent is hereby corrected as shown below:

Col. 4, Line 34, after "combination" insert "and".

Col. 4, Line 40, change "claim 2" to "claim 3".

Signed and Sealed this

Twenty-eighth Day of January, 1997

*Attest:*

BRUCE LEHMAN

*Attesting Officer* *Commissioner of Patents and Trademarks*